US005233399A

United States Patent [19]

Shiino et al.

[11] Patent Number: 5,233,399

[45] Date of Patent: Aug. 3, 1993

[54] CLEANING UNIT FOR IMAGE FORMING APPARATUS

[75] Inventors: Yutaka Shiino; Tsutomu Tetsuka, both of Ebina, Japan

[73] Assignee: Fuji Xerox Co., Ltd., Tokyo, Japan

[21] Appl. No.: 911,805

[22] Filed: Jul. 10, 1992

Related U.S. Application Data

[63] Continuation of Ser. No. 668,300, Mar. 14, 1991, abandoned.

[30] Foreign Application Priority Data

Mar. 19, 1990 [JP] Japan ..... 2-69211

[51] Int. Cl.[5] ..... G03G 21/00

[52] U.S. Cl. ..... 355/302; 118/652; 355/300

[58] Field of Search ..... 355/300-305, 355/297, 298, 299; 118/652; 15/256.51

[56] References Cited

U.S. PATENT DOCUMENTS

| | | | |
|---|---|---|---|
| 3,766,593 | 10/1973 | Becker et al. | 15/308 |
| 4,304,026 | 12/1981 | Borostyan | 15/308 |
| 4,530,597 | 7/1985 | Itaya et al. | 118/652 X |
| 4,640,608 | 2/1987 | Higaya et al. | 430/125 X |
| 4,664,505 | 5/1987 | Itaya et al. | 15/256.52 X |
| 4,674,865 | 6/1987 | Tada et al. | 118/652 X |
| 4,870,466 | 9/1989 | Iida | 355/297 |
| 4,875,081 | 10/1989 | Goffe et al. | 355/303 |
| 4,913,448 | 4/1990 | Bhagwat et al. | 355/215 X |
| 4,969,015 | 11/1990 | Sampe | 355/297 |
| 4,974,030 | 11/1990 | Tokunaga et al. | 355/296 |
| 4,982,230 | 1/1991 | Ogura et al. | 355/206 |
| 5,019,870 | 5/1991 | Bares | 355/298 |

*Primary Examiner*—A. T. Grimley
*Assistant Examiner*—T. A. Dang
*Attorney, Agent, or Firm*—Finnegan, Henderson, Farabow, Garrett & Dunner

[57] ABSTRACT

In a cleaning unit for an image forming apparatus, a housing; a brush, whose sectional profile is circular; the housing containing a photosensitive body which rotates; the brush included in the housing; an auger for discharging recovered toner separated from a surface of the photosensitive body by the brush; the auger disposed obliquely below the brush; and a flicker for scraping off the toner adhering to the brush while containing an outer surface portion of the brush.

7 Claims, 4 Drawing Sheets

CLEANING UNIT FOR IMAGE FORMING APPARATUS

This application is a continuation of application Ser. No. 07/668,300, filed Mar. 14, 1991, now abandoned.

BACKGROUND OF THE INVENTION

The invention relates to a cleaning unit for an image forming apparatus in which a photosensitive body and a cleaning unit, supported by a frame, is assembled in cartridge form and such cartridge-like assembly is made releasable in a direction of extraction from the image forming apparatus body.

To assemble both a photosensitive body and a cleaning unit in cartridge form, a space for the cleaning unit provided around the photosensitive body must be made small.

On the other hand, the cleaning unit has a brush which rotatably contacts the photosensitive body so that the brush can scrape off toner which has adhered to the surface of the photosensitive body. To prevent loading or overloading of the brush with the toner, a flicker is provided so as to contact the outer surface of the brush.

Location of the flicker becomes a problem when assembling the photosensitive body and the cleaning unit in cartridge form. That is, although a flicker is provided, if its location is improper, either the brush is loaded by the toner or the toner adhering to the brush cannot be recovered properly.

SUMMARY OF THE INVENTION

The invention has been made in view of the above circumstances. Accordingly, an object of the invention is to provide a cleaning unit for an image forming apparatus which is capable of preventing loading or overloading of the brush and improving the toner recovery performance even if a space for installing the cleaning unit is extremely small when the photosensitive body and the cleaning unit are assembled in cartridge form.

To achieve the above object, the invention is applied to a cleaning unit for an image forming apparatus, which has a housing including: a brush contacting a photosensitive body; a flicker contacting the outer surface portion of the brush; an auger, located below the brush, for discharging toner separated from the surface of the photosensitive body by the brush. In such a cleaning unit, a cover for covering an upper side of the brush interposing a small gap therebetween, and the flicker is arranged so as to project within the cover and at a position forming about 60 degrees with the perpendicular line passing through the center of the brush in a direction opposite to the photosensitive body.

The auger is disposed in a direction of spattering toner by the flicker and a space is provided above the auger.

The sectional profile of the flicker is such that an angle formed between a side surface located upstream of the flicker and the tangent line to the brush is set to 20 to 40 degrees, that an angle formed between a side surface located downstream thereof and the tangent line to the brush is set to 80 to 100 degrees, and the tip thereof is formed into a small arc.

Another aspect of the invention is applied to a cleaning unit for an image forming apparatus which includes: an elastic brush, whose sectional profile is circular and which contacts a photosensitive body while rotating; a flicker for scraping off toner adhering to the brush while contacting an outer surface portion of the brush; an auger for discharging recovered toner; and a housing containing the brush, the flicker, and the auger. In such a cleaning unit, the auger is disposed obliquely below the brush and the flicker is disposed adjacent to the point at which a tangent line to the brush at an upper portion of the brush passing through the center of the auger meets.

A space for suppressing a stream of air produced by the rotation of the brush is provided within the housing above the auger.

The toner adhering to the surface of the photosensitive body is scraped off by the rotation of the brush. And the toner adhering to the brush is flickered off by the flicker, spattered in the tangential direction to the rotation of the brush. Such spattered toner is then discharged by the auger. Under such conditions, the toner spattered upstream of the flicker is entrapped by the cover disposed above the flicker. The air stream produced by the rotation of the brush is suppressed by the space provided above the auger.

BRIEF DESCRIPTION OF THE DRAWINGS

FIG. 1(*b*) is a magnified cross-section of the view illustrated in FIG. 1(*a*), depicting the relationship between the flicker and the brush.

FIG. 2 is a sectional view showing an entire cleaning unit;

FIG. 3 is a schematic diagram for a description of an image forming apparatus.

DETAILED DESCRIPTION OF THE PREFERRED EMBODIMENT

An embodiment of the invention will be described with reference to the accompanying drawings.

Figure 3:
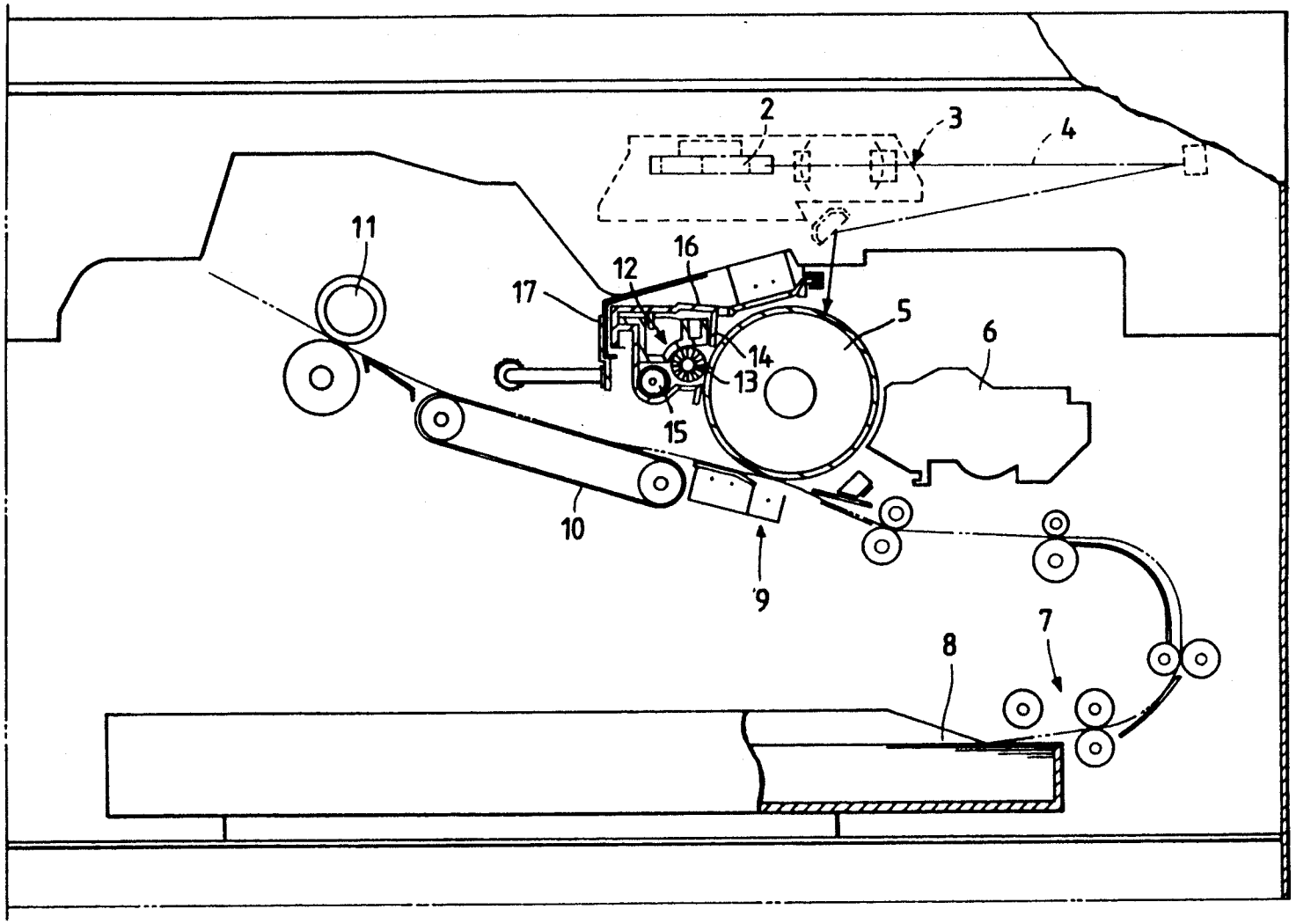

FIG. 3 schematically shows a construction of a laser printer using an image forming apparatus. An image signal sent from an external device (not shown) such as a computer or a word processor externally connected to the laser printer is formed into a latent image on photosensitive body 5 by laser beam 4 injected via optical system 3 including polygon mirror 2, and such latent image is then transferred at transfer section 9 on a sheet 8 fed from sheet feed unit 7.

Sheet 8 onto which a toner image has been transferred is forwarded to fusing unit 11 by transport 10 and is heated and fused thereat and then discharged.

Cleaning unit 12 includes: brush 13 contacting rotating photosensitive body 5 while rotating; doctor blade 14, which is located above brush 13 and which contacts the surface of photosensitive body 5 in a direction opposite to the direction of rotation of photosensitive body 5; auger 15 for discharging toner separated from photosensitive body 5; and housing 16 which contain the above components.

Photosensitive body 5 is supported by a frame (not shown) which is constructed integrally with housing 16 of cleaning unit 12. Photosensitive body 5 and cleaning unit 12 are assembled in a cartridge form and are retractable in a direction of extraction from the image forming apparatus body.

Figure 1A:
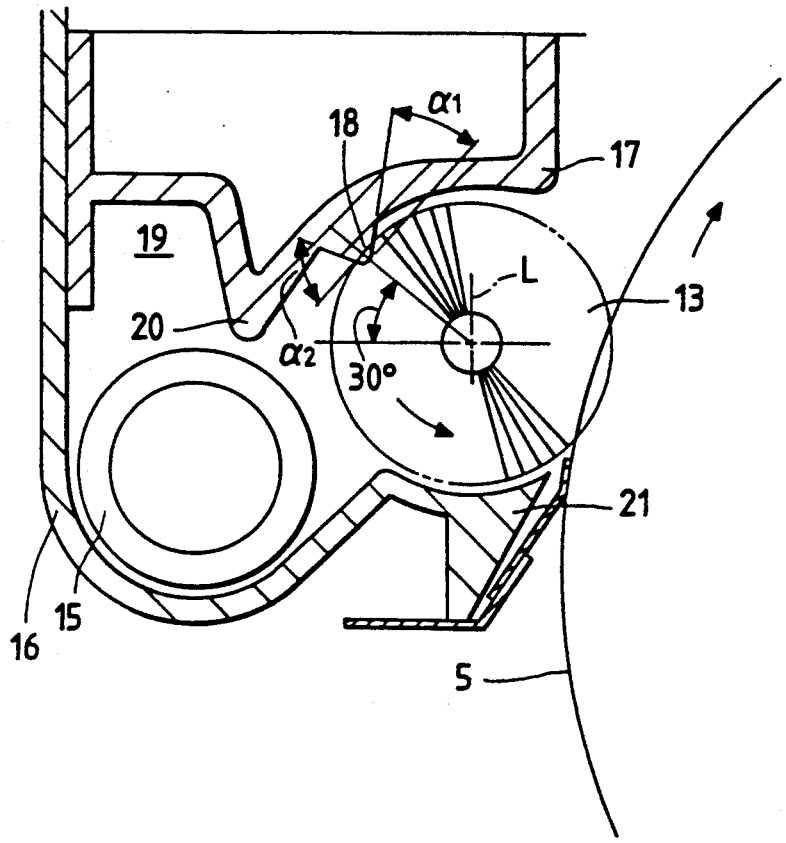
FIGS. 1 to 3 show an embodiment of the invention, of which FIG. 1(*a*) is a cross-sectional diagram for a description of a construction of a main portion thereof.
Figure 1B:
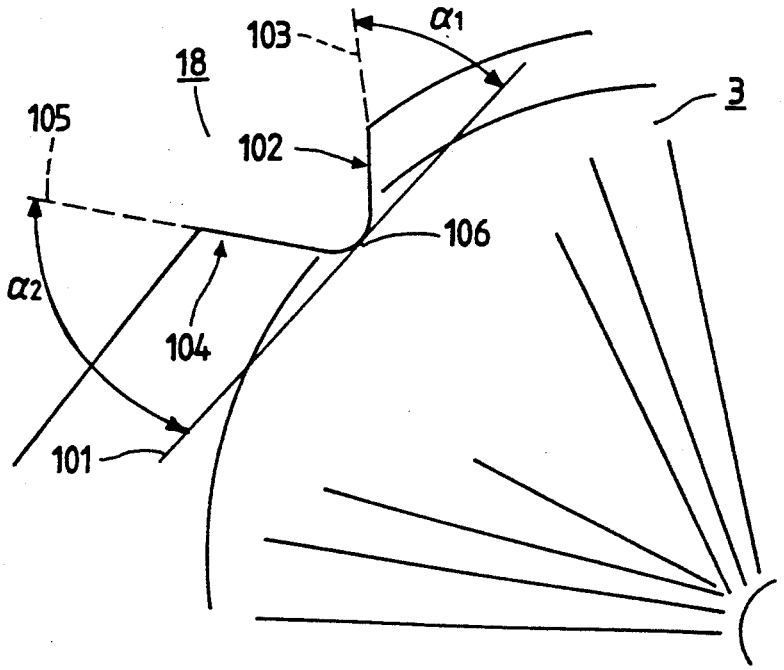
Figure 2:
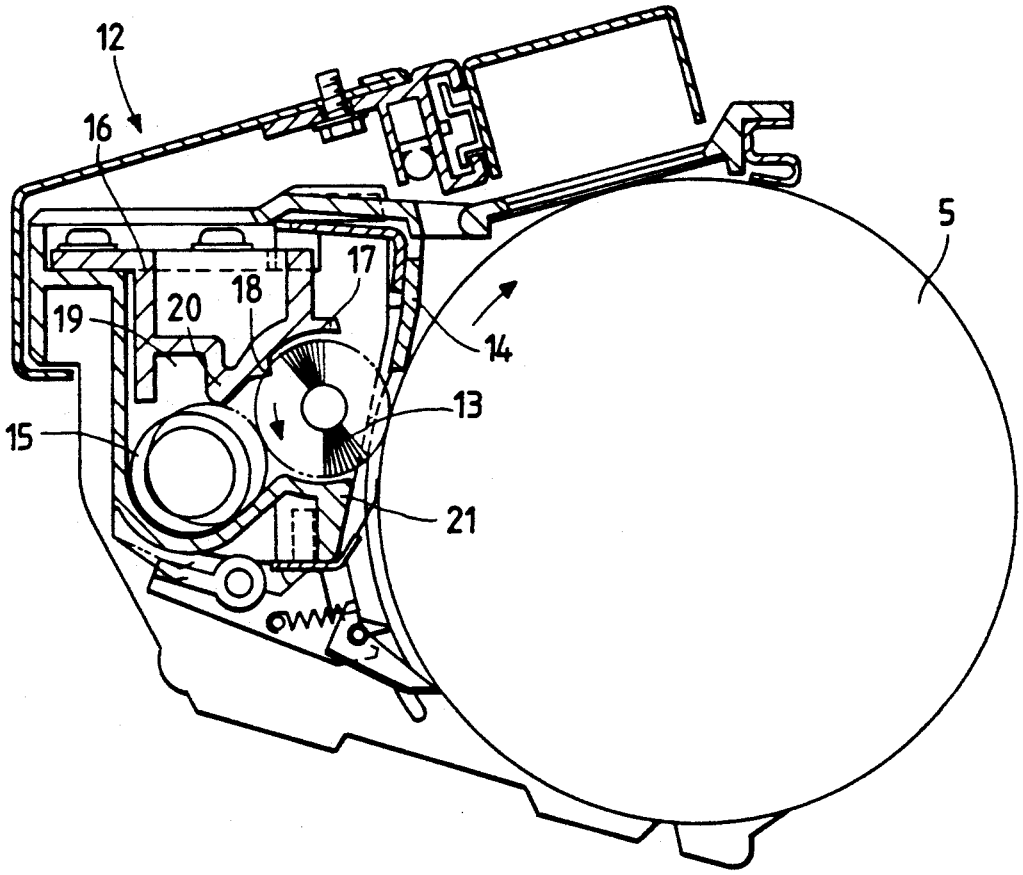

Cleaning unit 12 will be described in more detail with reference to FIGS. 1 and 2.

Brush 13 is a so-called "disturber brush." An upper portion of brush 13 is covered with cover 17 interposing a gap of, e.g., about 1 mm therebetween. Inside cover 17 is flicker 18 projecting at a position forming about 60 degrees with the perpendicular line L passing through brush 13 in a direction opposite to photosensitive body 5 as shown in FIG. 1(*a*).

The section of flicker 18 is such that the angle $\alpha_1$ formed between a side surface located upstream in a direction of rotation of brush 13 and a tangent line to brush 13 is set to 20 to 60 degrees, that the angle $\alpha_2$ formed between a side surface located downstream and a tangent line to brush 13 is set to 80 to 100 degrees, and that its tip portion forms a small arc. More specifically, in FIG. 1(*a*), the first angle $\alpha 1$ formed by a first surface 103 with the brush 5, i.e., the first angle defined between tangential plate 101 with which the brush in contact and extension plate 103 of the first surface at an intersection 106 defined between the extension plate 103 and the brush is acute angle which is in 20 to 60 degrees. The second angle $\alpha 2$ formed by second surface 104 with the brush, i.e., the angle defined between tangential plane 101 and an extension plate 104 of the second surface at the intersection 106 with the brush is an angle which is between 80 to 100 degrees.

On the upper side of auger 15 is a space 19 confronting an upper side of auger 15.

Auger 15 is flexible, and to prevent its deformation, auger lock 20 confronting an upper side of auger 15 is arranged so as to project from housing 16.

The lower side of brush 13 confronts lower cover 21 interposing a small gap of, e.g., 0.5 mm therebetween.

In the above construction, toner adhering to the surface of photosensitive body 5 is scraped off by the rotation of brush 13. And the toner adhering to brush 13 is flickered away by contacting flicker 18, spattered in a tangential direction of its rotation. Such spattered toner is then discharged by auger 15.

Under such conditions, the flicking effect of flicker 18 on brush 13 is satisfactory, causing no loading of brush 13.

Although a stream of air is produced within housing 16 in a direction of rotation of brush 13 by the rotation of brush 13, space 19 provided above auger 15 acts as an air deposit, thereby suppressing the air stream.

The toner spattered upstream of flicker 18 is entrapped by cover 17 disposed above flicker 18.

Figure 4:
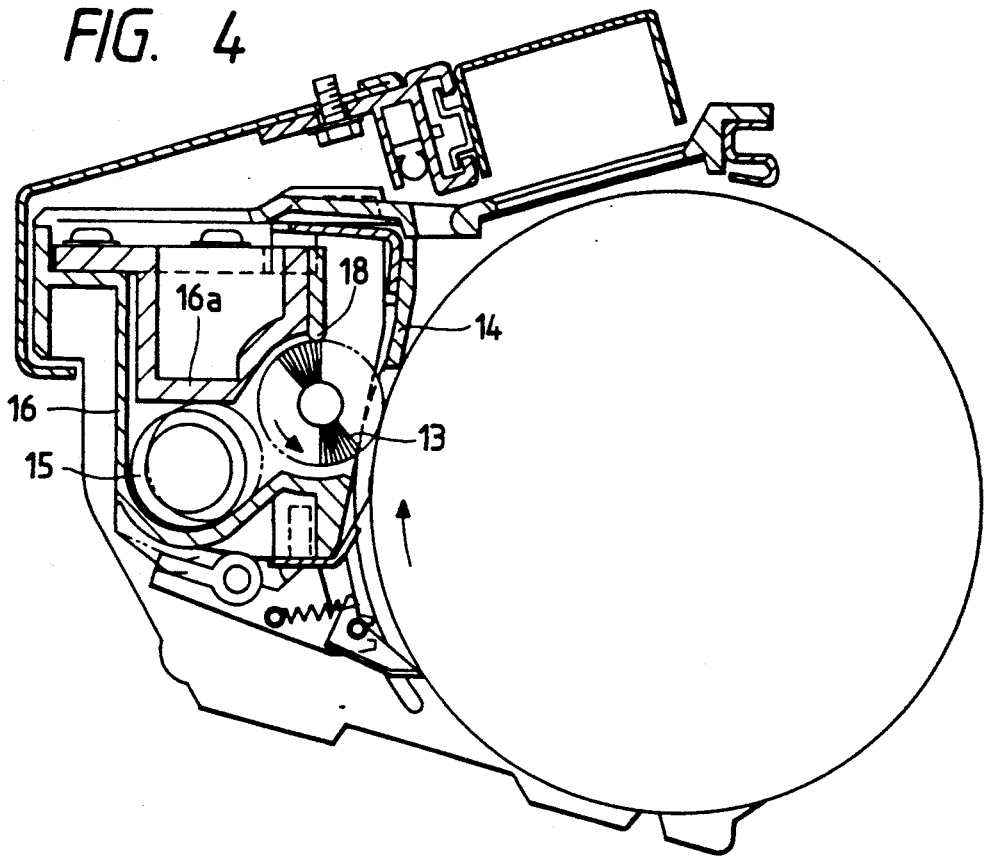
FIGS. 4 and 5 are sectional views showing testing machines, each of which is distinguished from the embodiment of the invention.
Figure 5:
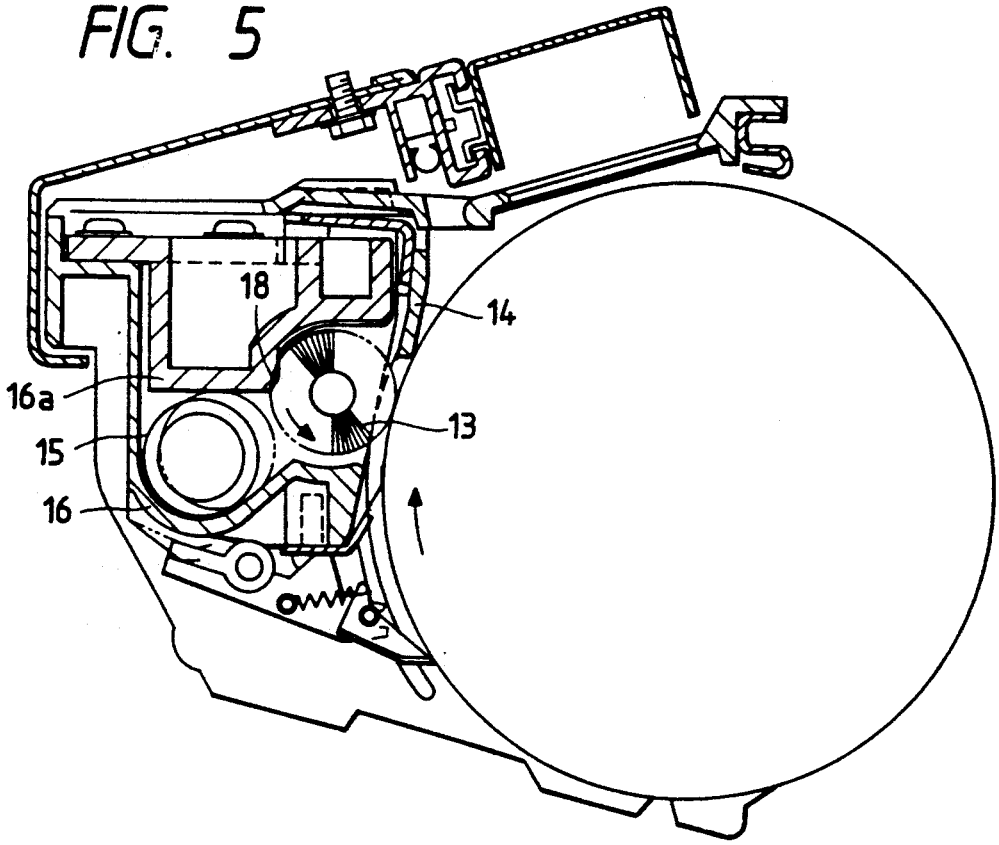

The inventors conducted experiments using testing machines such as shown in FIGS. 4 and 5 in addition to the above embodiment.

Specifically, a first testing machine shown in FIG. 4 has a gap of 1.5 mm with respect to the upper cover, while flicker 18 is disposed immediately above brush 13 and housing wall 16 comes immediately above auger 15. A second testing machine shown in FIG. 5 has flicker 18 immediately beside brush 13 and housing wall 16 immediately above auger 15.

Brushes 13 of these testing machines were loaded. A stream of air was produced within housing 16, which air stream then produced a cloud of toner and the toner cloud flew backward into photosensitive body 5.

According to the invention, loading of brush 13 can be prevented even if a space within cleaning unit 12 is extremely small when photosensitive body 5 and cleaning unit 12 are assembled in a cartridge form. Further, a stream of air produced within housing 16 of cleaning unit 12 can be suppressed by space 19 provided above auger 15 so that no toner cloud leaks from cleaning unit 12, thereby improving the capability of recovering the toner.

What is claimed is:

1. A cleaning unit for an image forming apparatus for removing toner from a photosensitive surface comprising:

a housing having a cover;

a brush disposed within the housing in contact with the photosensitive surface;

a doctor blade disposed within the housing adjacent the brush, and in contact with the photosensitive surface;

a flicker projecting from the cover and in contact with the brush for removing toner adhering to the brush, the flicker being disposed approximately 30 degrees above a horizontal line passing through the center of the brush, the flicker having a first surface and a second surface adjacent to and connected to the first surface forming an essentially triangular cross-section, the first surface defining a first angle in the range of between 20 and 40 degrees with a tangent to the brush at a point where the flicker is in contact with the brush, the second surface defining a second angle in the range of between 80 and 100 degrees with the tangent at the point where the flicker is in contact with the brush;

a compartment defined by the housing adjacent the brush for collecting toner removed from the brush by the flicker; and an auger disposed within the compartment for discharging from the compartment the toner recovered by the brush from the photosensitive surface.

2. The apparatus of claim 1, further comprising:

an auger lock projecting downwardly from the cover into the compartment for preventing the auger from ejecting from the compartment within the housing.

3. The apparatus of claim 1, wherein:

the photosensitive surface is cylindrical and rotates in an angular direction; and the brush is cylindrical and rotates oppositely to the angular direction of the photosensitive surface.

4. The apparatus of claim 1, wherein the brush comprises an elastic material.

5. The apparatus of claim 1, further comprising:

a stream suppression compartment disposed above the auger within the housing for suppressing a stream of air produced by the rotation of the brush.

6. A cleaning unit for an image forming apparatus for removing toner from a photosensitive surface comprising:

a housing;

a cylindrically-shaped brush disposed within the housing in contact with the photosensitive surface;

an auger for discharging from the housing toner separated from the photosensitive surface by the brush;

a flicker for removing the toner adhering to the brush and for containing the brush; and the auger being disposed obliquely below the brush so that a line tangent to the brush at a point where the flicker contacts the brush passes through the center of the auger.

7. The apparatus of claim 6, further comprising:

means defining a space within the housing above the auger for suppressing a stream of air produced by the rotation of the brush.

* * * * *